United States Patent [19]

Wentink

[11] 4,172,407

[45] Oct. 30, 1979

[54] SUBMUNITION DISPENSER SYSTEM

[75] Inventor: Richard S. Wentink, La Jolla, Calif.

[73] Assignee: General Dynamics Corporation, San Diego, Calif.

[21] Appl. No.: 937,682

[22] Filed: Aug. 25, 1978

[51] Int. Cl.[2] ..... F41F 5/02

[52] U.S. Cl. ..... 89/1.5 E; 89/1 A; 102/7.2; 102/69

[58] Field of Search ..... 102/7.2, 5, 69, 61; 89/1.5 R, 1.5 E, 1 A

[56] References Cited

U.S. PATENT DOCUMENTS

| | | | |
|---|---|---|---|
| 2,330,815 | 10/1943 | Dunajeff | 102/7.2 X |
| 2,925,965 | 2/1960 | Pierce | 102/61 X |
| 3,517,584 | 6/1970 | Robinson et al. | 89/1.5 R |
| 3,534,653 | 10/1970 | Specht | 102/7.2 X |
| 3,757,696 | 9/1973 | Derk | 102/69 X |
| 3,907,225 | 9/1975 | Welther | 102/69 X |
| 3,948,175 | 4/1976 | Bucklisch | 102/5 |
| 4,009,661 | 3/1977 | Imrie | 102/7.2 X |

*Primary Examiner*—David H. Brown
*Attorney, Agent, or Firm*—John R. Duncan

[57] ABSTRACT

A system for dispensing a large number of submunitions from a missile or aircraft in uniform selected pattern. Small, cylindrical submunitions are carried in ejection tubes in a generally cylindrical housing. Sets of tubes are arranged in parallel planar arrangement approximately perpendicular to the housing longitudinal axis, with different sets at different angles to vertical. Timing means cause the submunitions to be ejected at selected times, and drag means on the individual submunitions are actuated at selected times so that the submunitions strike the ground along lines perpendicular to the line of housing mount. This system is especially useful with low-flying cruise missiles in attacking airfields, since a plurality of cuts across the airfield can be inflicted as the missile traverses the length of the field.

8 Claims, 11 Drawing Figures

| PARAMETER | RUNWAY | | | TAXIWAY | | |
|---|---|---|---|---|---|---|
| | TUBES | | | TUBES | | |
| | 1 | 2,4 | 3,5 | 1 | 2,4 | 3,5 |
| LATERAL OFFSET (FT) | 0 | 53 | 106 | 0 | 28 | 56 |
| IMPACT ANGLE (DEG) | -35 | -33 | -30 | -35 | -33 | -32 |
| VELOCITY AT IMPACT (FPS) | 120 | 122 | 145 | 120 | 122 | 127 |
| $\phi$ (DEG) | 90 | 70 | 45 | 90 | 70 | 45 |
| EJECTION VELOCITY (FPS) | 60 | 60 | 60 | 60 | 60 | 60 |
| START SUBMUNITION TIMER | 0.0 | 0.04 | 0.14 | 0.0 | 0.01 | 0.05 |
| LAUNCH TIME | 0.10 | 0.14 | 0.24 | 1.40 | 1.41 | 1.45 |
| DEPLOY PARACHUTE | 1.40 | 1.44 | 1.54 | 1.40 | 1.41 | 1.45 |
| IMPACT | 5.60 | 5.44 | 5.08 | 5.60 | 5.51 | 5.25 |

SUBMUNITION DISPENSER SYSTEM

BACKGROUND OF THE INVENTION

This invention relates in general to weapon systems and, more specifically, to a submunition dispensing system especially adapted for attacking airfield landing strips.

The ability to destroy enemy airfields or to render them at least temporarily unusable is of utmost importance in resisting a non-nuclear attack. An attacking armored force is extremely vulnerable in the absence of air cover. Therefore, a number of weapon systems has been developed for use in a conventional airfield attack mission.

Single or small numbers of large munitions, delivered by aircraft or ballistic missiles, have a number of disadvantages. High accuracy necessary to significantly damage an airfield is difficult to achieve with longer range ballistic missiles, or with aircraft attacking a well-defended target. The small number of relatively large damaged areas produced is relatively easy to repair, and often aircraft can continue to use portions of an airfield having a few damaged areas.

Attempts have been made to deliver a larger number of submunitions by ballistic missiles or aircraft to increase the size of the damaged or destroyed areas. However, submunitions delivered by ballistic missiles tend to land in an approximately round pattern and cannot be caused to land evenly along an elongated landing strip or taxiway. Submunitions delivered by aircraft tend to fall in a narrow line. It is difficult to vary the pattern width of submunition landing points to accommodate landing strips of different dimensions.

Ideally, submunitions will strike the landing strip in lines across the width of the strip, with impact points sufficiently closely spaced to prevent use by aircraft. A number of such lateral cuts spaced along the length of the strip will render the entire strip unusable and will be difficult and time-consuming to repair.

Thus, there is a continuing need for improved submunition dispensing systems for the conventional airfield attack mission.

SUMMARY OF THE INVENTION

The above problems, and others, are overcome by a submunition dispensing system useful with cruise missiles and other aircraft which can dispense submunitions in a plurality of spaced lines across the width of a landing strip, runway or taxiway. A housing, which may be the foreward fuselage of a cruise missile between guidance means in the nose and the fuel tanks and engine in the aft section, contains a plurality of sets of submunition ejection tubes and the firing timing means. Each set includes two or more ejection tubes in a contiguous parallel planar array arranged substantially perpendicular to the longitudinal axis of the housing at a selected angle to the vertical axis of the housing. A single "cut" across the landing strip is made by firing submunitions from tubes at different angles (typically, one from each set) at selected times, then actuating a drag means on each submunition at a selected time, so that the submunitions contact the landing strip in the desired pattern, such as a line perpendicular to the centerline of the landing strip. Timing and control means which sets both drag means actuation time and ejection time for the submunitions is capable of varying the length of the "cut", the pattern of the line of the cut, and the number of cuts made along the landing strip.

An entire landing strip or similar facility can be rendered totally unusable by this dispenser system in a single pass, a result which cannot be accomplished by any other submunitions delivery system.

BRIEF DESCRIPTION OF THE DRAWING

Details of the invention, and of a preferred embodiment thereof, will be further understood upon reference to the drawing, wherein.

DETAILED DESCRIPTION OF THE INVENTION

Figure 1:
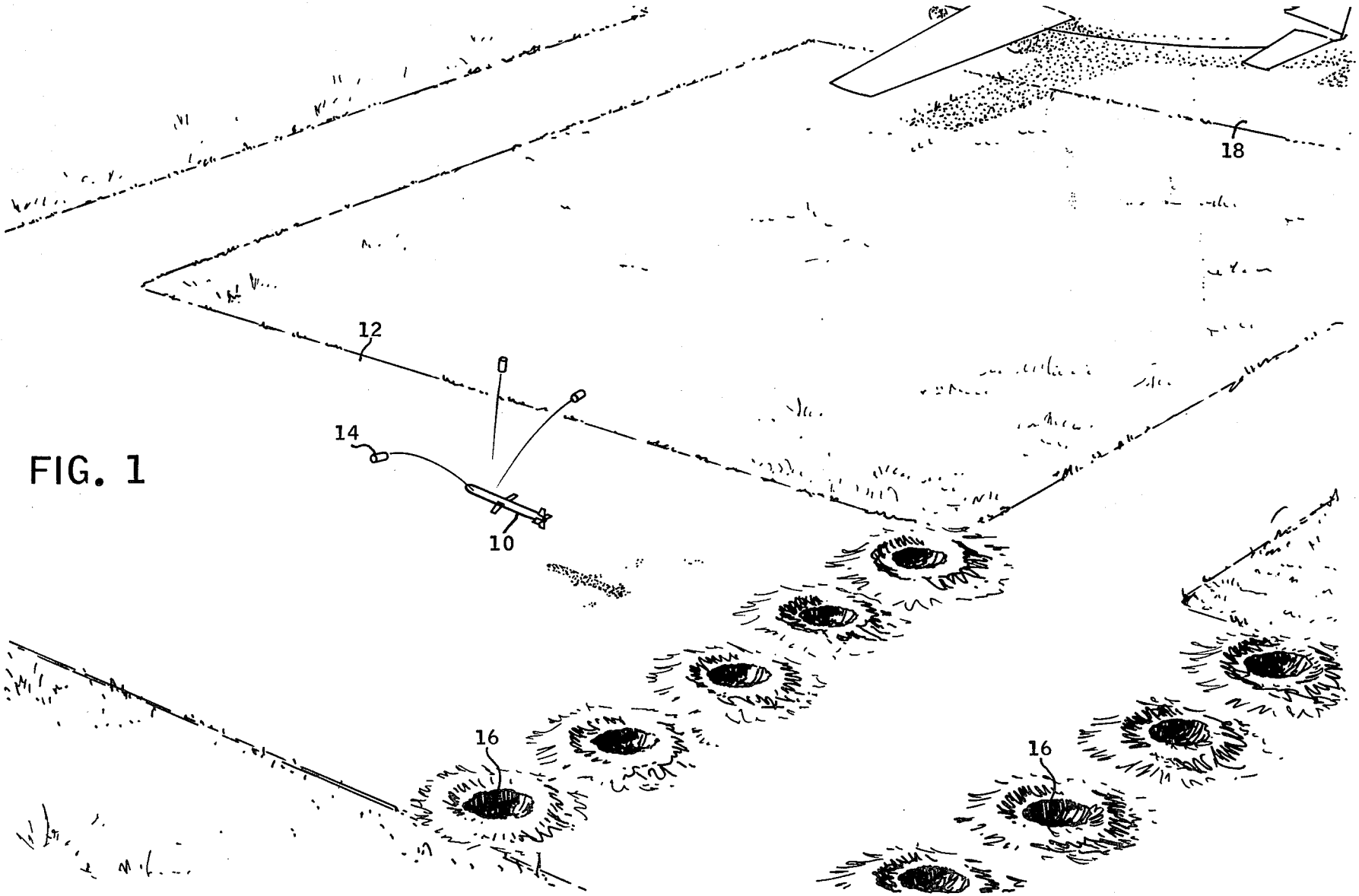
FIG. 1 is a perspective aerial view showing a cruise missile attacking an airfield with the novel submunitions dispensing system.
Figure 2:
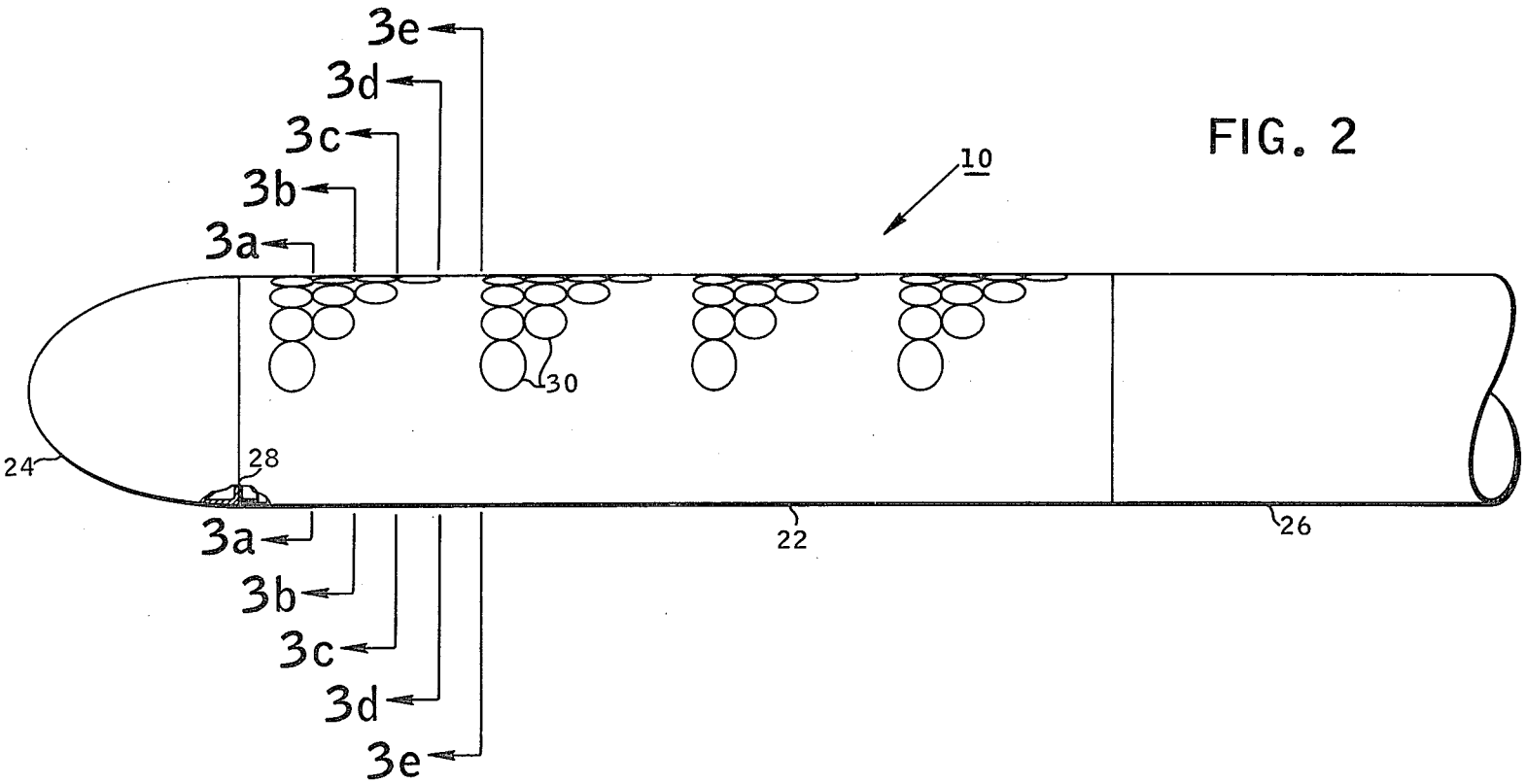
FIG. 2 is a side elevation view of the dispensing system in a cruise missile.

Referring now to FIG. 1, there is seen a perspective view of the submunition dispensing system of this invention in operation. In this preferred embodiment, the dispensing means is carried in the forebody of a cruise missile 10. Cruise missiles are a preferred delivery vehicle because of their high navigational accuracy, ability to fly in a very low, terrain-following mode and ability to attack heavily-defended targets where a piloted aircraft would not be risked. Of course, if desired, the dispenser could be carried in a conventional aircraft, either in a pod carried in front of, above, or behind a wing or in the aircraft fuselage behind the cockpit.

As seen in FIG. 1, the cruise missile 10 flies the length of runway 12, ejecting series of submunitions 14 at different angles to the vertical and at precisely controlled intervals so as to strike runway 12 along precisely spaced lines 16 perpendicular to the runway centerline. Of course, impact lines 16 could be other than as shown, depending on the controlled ejection sequence. For example, horseshoe shaped lines or zigzag lines could be produced. Preferably, the impact points making up lines 16 are shown together to form a substantially continuous "cut" across the runway, with a series of spaced cuts making the runway totally unusable.

The ejection control means, in combination with the altitude and speed of cruise missile 10 can be adjusted to provide cut length and spacing of lines 16 to cut the target. For example, in attacking a taxiway 18 or an aircraft carrier, short closely-spaced lines 16 would be preferred, while longer lines 16 might be preferred to cut a wide sod landing strip. As shown, the first three of a sequence of five submunitions have just been ejected from the dispenser.

The arrangement of submunition ejection means within cruise missile 10 is illustrated in FIGS. 2 and 3*a* through 3*e*.

A number of parallel contiguous sets of ejection tubes 20 are arranged at different angles to the vehicle vertical axis in the forward body 22 of cruise missile. The cruise missile guidance system is mounted in nose 24 of cruise missile 10. Aft body 26 contains the fuel tanks, engine, wings, etc. of cruise missile 10. Forward body 22 is a separate module which can be removed and replaced with other devices, such as single large warheads, reconnaisance cameras, etc.

Figure 3E:
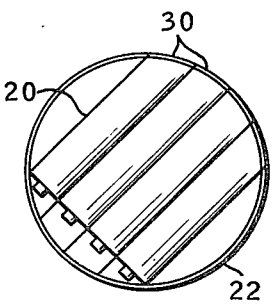
FIGS. 3*a* through 3*e* are vertical sections through the dispensing system, taken on lines 3*a*—3*a* through 3*e*—3*e*, respectively, in FIG. 2.
Figure 3D:
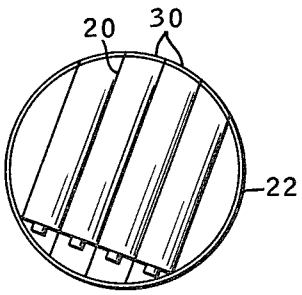
Figure 3C:
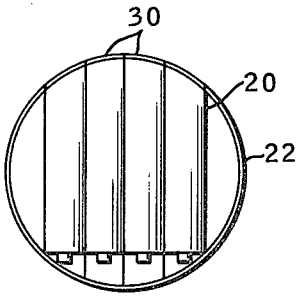
Figure 3B:
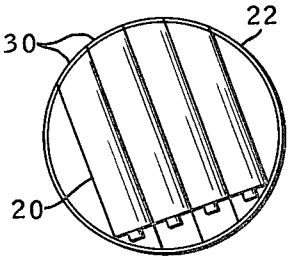
Figure 3A:
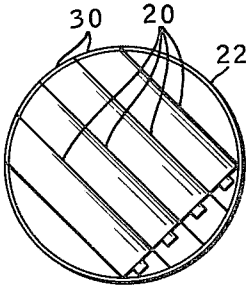

In the embodiment shown, two sets of ejection tubes, as seen in FIGS. 3*a* and 3*e*, are oriented at about ±45° to the vehicle vertical axis, with the tubes in the sets shown in FIGS. 3*b* and 3*d* at ±20° and those in the set shown in FIG. 3*c* aligned with the vertical axis. This arrangement continues in a similar manner through the length of forward body 22. A space may be provided at 28 or within nose 24 to house the ejection sequence control means.

During flight prior to ejection of submunition 14 from tubes 20, the ejection openings are preferably covered for aerodynamics reasons. Best results are obtained with small plastic snap-in caps 30 which are pushed off by the emerging submunition. Alternately, frangible covers may be used (to be broken away or pierced by the emerging submunition) or a shroud could cover all or portions of the upper half of forward body 22, to be blown off by suitable pyrotechnic means prior to submunition ejection.

While in the preferred embodiment shown, four submunition ejection tubes 20 make up each set, and five different ejection angles are provided, these numbers may be varied, if desired. The plane of each set of parallel contiguous tubes is preferably perpendicular to the centerline of forward body 22. If desired, the sets may be angled either forward or aft up to about 30°.

Figure 4:
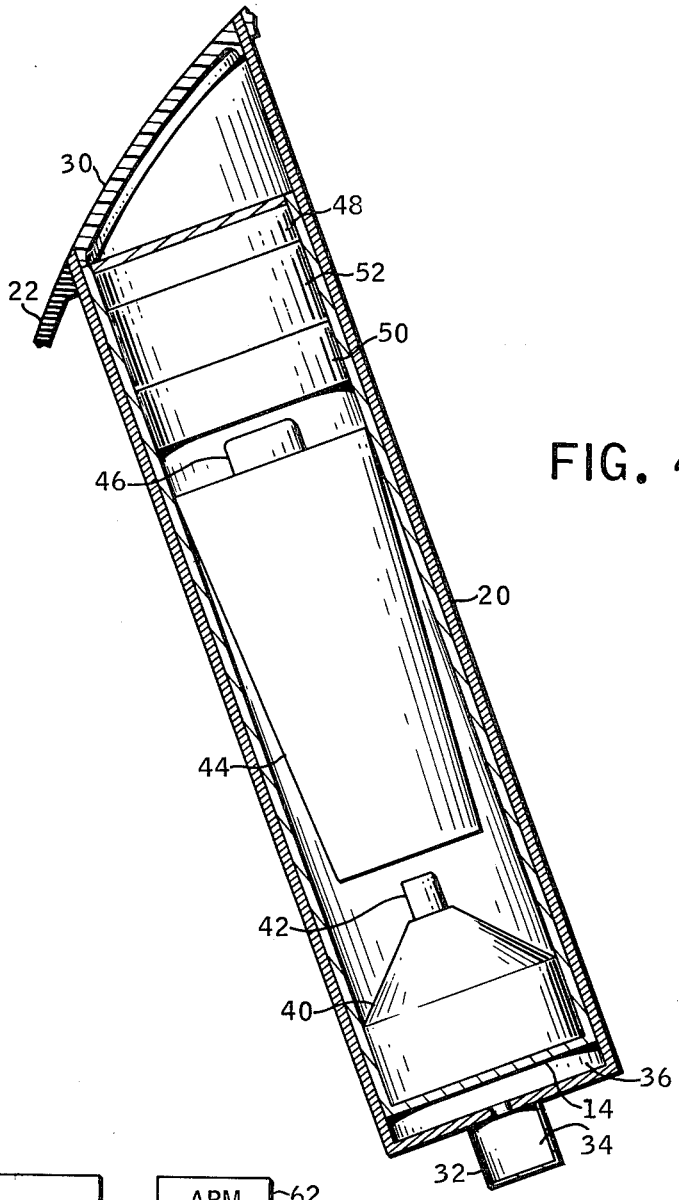
FIG. 4 is a schematic section view taken approximately along the centerline of a submunition in an ejection tube.

Details of a typical ejection tube 20 containing a submunition 14 is shown in a schematic section view in FIG. 4. In this view, the wall of ejection tube 20 and the casing of the submunition 14 are cut away to reveal the inner components of submunition 14.

Ejection tube 20 is aligned with an opening in forward body 22 which is closed by a snap-fit plastic cap 30. At the opposite end, tube 20 is connected to a small housing 32 containing a gas generating pyrotechnic means 34 which, when activated, generates a gas which expands in space 36, ejecting submunition 14 from tube 20 in a manner similar to the operation of a conventional military mortar. Cap 30 is automatically popped off by the exiting submunition.

A preferred submunition 14 for use in this system includes a conventional hollow conical shaped charge 40 with a detonator 42 for penetrating a runway and a main explosive charge 44 with a detonator 46 to explode after penetration of the runway. A stabilizing means, such as drogue means, a streamer, or fins extends from container 48 immediately after ejection to orient submunition 14 for flight with the shaped charge end leading. A conventional timer within space 50 actuates a main drag device, such as a parachute, in container 52 at the proper time to provide the desired impact point.

While the above described submunition is preferred for the airfield attack mission, other submunitions may be used, if desired, such as shrapnel generating anti-personnel weapons designed to explode prior to ground impact.

Figure 5:
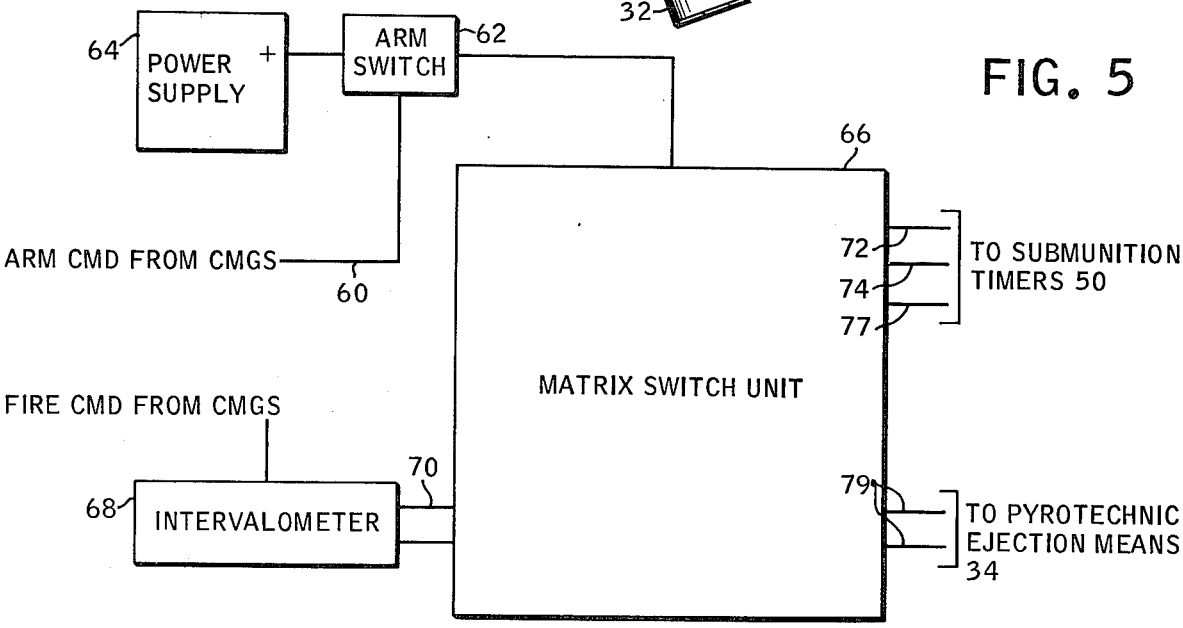
FIG. 5 is a block diagram of the dispenser control means.

A functional block diagram of a system for actuating the submunition ejection means and each submunition main drag means in a selected sequence to provide a selected impact pattern is provided in FIG. 5.

As the cruise missile approaches the target, the cruise missile guidance system transmits a signal through line 60 to arm switch 62 closing the switch and connecting power supply 64, typically a battery, to the matrix switch unit 66. As the cruise missile reaches the target, a "fire" command is transmitted from the cruise missile guidance system to an intervalometer (event sequencer) 68. The intervalometer 68 is programmed to generate binary encoded timing command signals on line 70. These timing signals are decoded in the matrix switch unit 66 to provide the drag means timer 50 start command and activation of the ejection means. The timer 50 which operates the submunition main drag means is powered through lines 72 and 74. Prior to ejection, the timers in different submunitions are activated by signals passing through line 77. Power switches in the switch matrix unit 66 are activated by the decoded ejection signals to provide electrical current through lines 79, thus activating the pyrotechnic ejection means 34 in the ejection tubes. While two lines 79 and one line 77 are shown for clarity, ordinarily more are provided depending upon the number of submunitions 14 carried. In operation, the drag means timer 50 in each submunition is started by a signal at a selected time in the sequence so that the submunitions will be ejected by activation of the pyrotechnics 34 through the proper lines 79. Any sequence of ejection tube operation, to provide any desired impact pattern, may be selected through intervalometer 68 programming in a well-known manner.

While the programable system schematically illustrated in FIG. 5 is preferred for convenience and flexibility, any other suitable means may be used for actuating the drag means timer 50 and ejection tube pyrotechnics 34. For example, several simple rotary multiple-contact switches could be used to actuate ejection tubes in a "ripple" mode proportional to the speed of switch rotation, or could be fired in sets or salvos by remote control from a distance or where the dispenser is carried on a manned aircraft.

Figure 6:
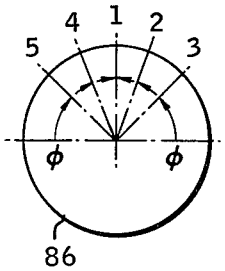
FIG. 6 is a table illustrating various parameters in the operation of the dispenser.

Typical operating parameters which could be used to set the dispenser control system to provide transverse straight line cuts across a runway or taxiway are provided in the table of FIG. 6. These parameters relate to a low-flying cruise missile at a given altitude and speed, and would be varied for other altitudes and speeds.

The first set of parameters cover the case of a relatively wide runway. The angular relationship of five submunitions in five ejection tubes is schematically shown in diagram 86 within the table. It is desired to have submunition No. 1 strike the runway centerline, submunitions 2 and 4 strike with lateral offsets of 53 feet either side of the centerline and submunitions 3 and 5 at lateral offsets of 106 feet.

In order that the shaped charges 40 of each submunition 14 will penetrate a concrete runway, it is preferred that the impact angle be 30° or greater from the horizontal. In the embodiment shown, the angles to the horizontal of the submunition at impact are 35°, 33° and 30° for submunitions 1, 2 and 4, and 3 and 5, respectively. As shown in the table, the impact velocities are sufficient to assure good surface penetration by the submunitions. In order to achieve these parameters, the five submunitions should be arranged in ejection tubes as follows: No. 1 at 90°; Nos. 2 and 4 at 70°; and Nos. 3 and 5 at 45° to the horizontal.

In order to have the line of impact at a selected point along the runway centerline, the submunition parachute timers 50 are started at the times indicated, in seconds. Each timer 50 runs for the same pre-established time, typically 1.4 seconds. The submunitions are launched in the sequence indicated by the launch time given in the table, all at the same ejection velocity, then the parachutes open and impact occurs at the times listed. As can be seen from the table, a variety of impact patterns and lateral effects can be obtained by varying the different parameters.

One such variation is given in the table head "Taxiway". In this case, a narrow taxiway is to be attacked. In order to obtain the more narrow lateral offsets, (still at same given cruise missile speed and altitude), the submunition timers are started earlier with respect to the launch times, which decreases the time between launch and drag means actuation, so as to provide less lateral offset. The relationship of ejection times are again selected to give a substantially straight line cut perpendicular to the taxiway centerline. Any other pattern may be selected. For example, a horseshoe-shaped pattern may be obtained by launching all submunitions at the same time, after starting the submunition parachute timers at the same time.

Figure 7:
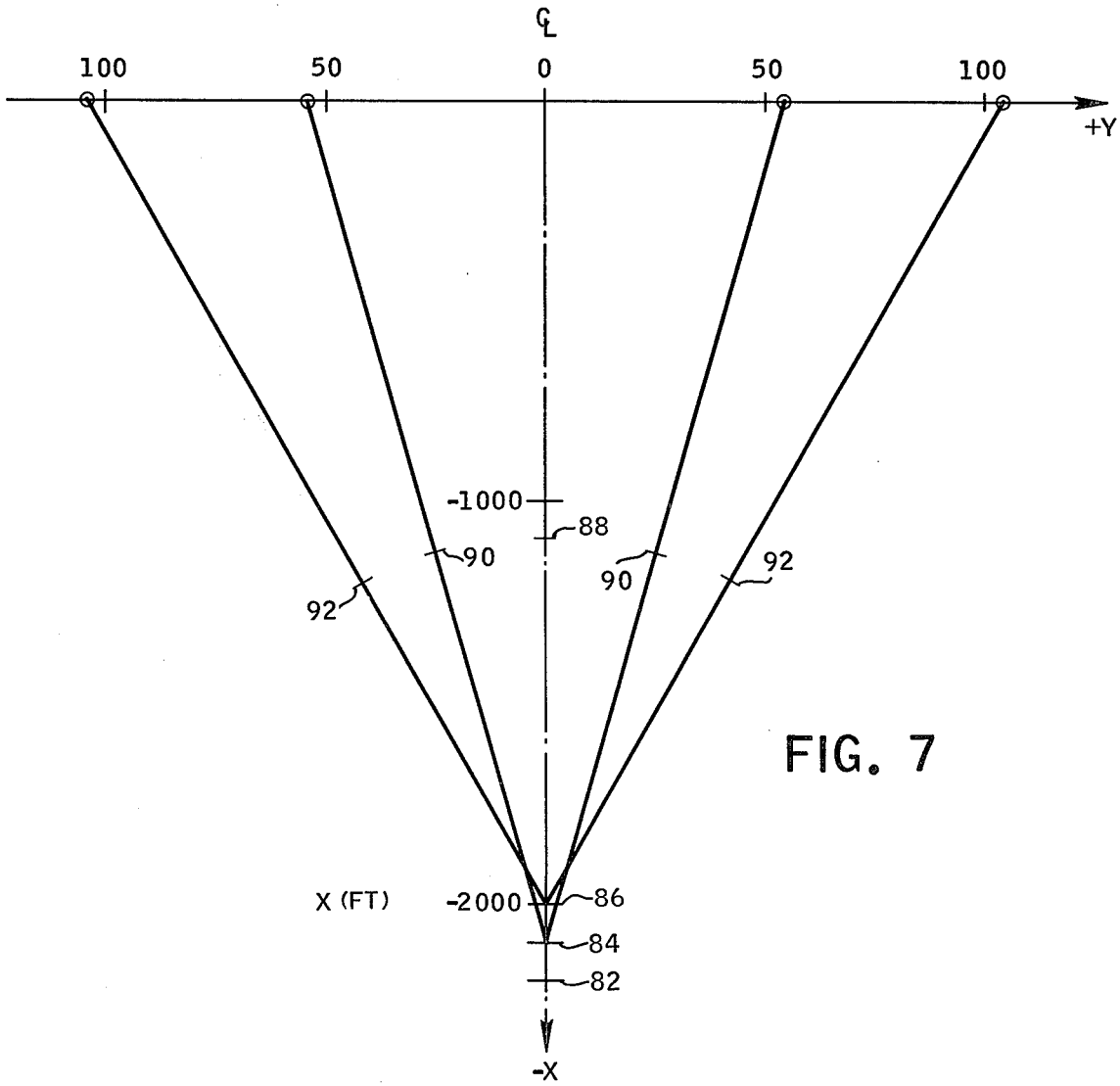
FIG. 7 is a diagram schematically illustrating one firing sequence.

The flight of the submunitions for the example given in the "Runway" column of FIG. 6 is schematically illustrated in FIG. 7. A cruise missile is flying along the X-axis from the bottom to the top of the diagram. At a pre-determined distance from the desired impact line (the Y-axis line), typically at +2220 feet uprange of the impact line, the firing sequence is begun. Submunition No. 1 is ejected at point 82, Submunition Nos. 2 and 4 at point 84, and Submunitions Nos. 3 and 5 at point 86, corresponding to launch times 0.10, 0.14 and 0.24 in the table. At points in time 88, 90 and 92, the parachutes for submunitions 1, 2 and 4, and 3 and 5, respectively, open. At the impact times given in the table, these submunitions impact along the Y-axis line as shown. While the submunitions tend to fly "in formation" with the cruise missile until the parachutes open, thereafter the forward flight velocities of the submunitions are slowed sufficiently by the parachutes so that the cruise missile is well away at submunition impact.

Other variations, applications and ramifications of this invention will occur to those skilled in the art upon reading this disclosure. These are intended to be included within the scope of this invention, as defined by the appended claims.

I claim:

1. Submunition delivery system for attacking extended area targets which comprises:

an elongated housing;

a plurality of sets of parallel tubes within said housing;

the centerline of each of said tubes lying in a plane which is at an angle of at least about 60° to the longitudinal axis of said elongated housing;

at least some of some sets of tubes oriented at different angles to the vertical than other sets of tubes;

each of said tubes adapted to contain a submunition and a means of ejecting said submunition from said tube;

first timing means actuating ejection means to cause said submunitions to be ejected in a selected sequence; and second timing means carried by said submunitions to actuate a flight drag means at a selected time.

2. The system according to claim 1 wherein said tubes lie in planes perpendicular to the longitudinal axis of said housing and sets of said tubes are oriented at ±45°, ±20°and 0° to the vertical.

3. The system according to claim 1 wherein said ejection means comprises pyrotechnic gas generators in spaces communicating with said tubes behind said submunitions.

4. The system according to claim 1 wherein said elongated housing makes up a portion of the forward fuselage of a cruise missile.

5. Cruise missile submunition dispenser for attacking airfields which comprises:

an elongated dispenser housing which makes up a substantial portion of a forward cruise missile body;

said housing having a vertical centerline when said missile is in flight;

a plurality of sets of tubes within said housing, the tubes in each set oriented in a substantially contiguous, parallel, planar arrangement, the plane of each set lying approximately perpendicular to the longitudinal axis of said housing;

different sets of tubes positioned at different selected angles to the housing vertical centerline;

each of said tubes containing a submunition and having means to eject the submunition from the tube;

each submunition comprising an explosive charge, a stabilizing device to stabilize initial flight after ejection, a main drag device and timing means to deploy said main drag device at a selected time after ejection; and control means to arm the submunitions; start the submunition timing means and initiate submunition ejection all at selected times;

whereby said submunitions strike the ground in a repeating lateral impact pattern.

6. The dispenser according to claim 5 said submunition timing means comprises a timer carried by said submunition which actuates a flight drag means at a selected time.

7. The dispenser according to claim 5 wherein sets of tubes are oriented at ±45°, +20°, 0°, −20° and −45° to the vertical axis.

8. The dispenser according to claim 5 wherein said ejection means comprises pyrotechnic gas generators in a space communicating with said tubes behind said submunitions.

* * * * *